United States Patent [19]

Cantwell et al.

[11] Patent Number: 4,877,044

[45] Date of Patent: Oct. 31, 1989

[54] TENT, TENT RIBS, AND METHOD OF ERECTING TENTS

[75] Inventors: Robert R. Cantwell, Leslie; Raymond F. Hallemann; Deborah M. Zumsteg, both of New Haven, all of Mo.

[73] Assignee: American Recreation Products, Inc., St. Louis, Mo.

[21] Appl. No.: 236,846

[22] Filed: Aug. 26, 1988

[51] Int. Cl.[4] ..... E04H 15/40

[52] U.S. Cl. ..... 135/104; 52/DIG. 13; 135/114

[58] Field of Search ..... 52/2, DIG. 13; 135/89, 135/90, 101, 104, 114

[56] References Cited

U.S. PATENT DOCUMENTS

| | | | |
|---|---|---|---|
| 4,192,333 | 3/1980 | Sato | 135/104 |
| 4,197,681 | 4/1980 | Holcombe | 135/101 |
| 4,236,543 | 12/1980 | Moss | 135/104 |
| 4,265,259 | 5/1987 | Gillis | 135/104 |
| 4,265,261 | 5/1981 | Barker | 135/93 |
| 4,505,286 | 3/1985 | Madion | 135/95 |
| 4,533,170 | 8/1985 | Banks | 135/88 |
| 4,766,918 | 8/1988 | Odekirk | 135/102 |

*Primary Examiner*—Henry E. Raduazo

*Attorney, Agent, or Firm*—Senniger, Powers, Leavitt and Roedel

[57] ABSTRACT

A tent of the type comprising a fabric shell suppoprted on a skeleton frame having at least two criss-crossing ribs, the ribs having patches of mating halves of a hook-and-loop type fastening material on the portions of the ribs that criss-cross, to releasably attach the ribs at the point where they criss-cross and stabilize the frame.

11 Claims, 1 Drawing Sheet

TENT, TENT RIBS, AND METHOD OF ERECTING TENTS

BACKGROUND OF THE INVENTION

This invention relates generally to tents, and in particular to tents of the type having a skeleton frame adapted to support a fabric shell forming the walls of the tent.

Tents of the type having skeleton frames can have a wide variety of shapes and constructions, including, for example mushroom and dome tents. The skeleton frame is usually positioned around the exterior of the fabric shell, although it could be positioned inside of the shell. The frame typically comprises at least two criss-crossing ribs. The ribs and the fabric shell generally cooperate to form a stable, free-standing structure, although until the tent is completely erected the frame is prone to collapse. The erection of this type of tent is often quite difficult. Generally the frame is erected first, but lacking any structural integrity itself, it must be held in place while the fabric shell is suspended from the frame. The person erecting the tent must either attempt to suspend the shell with one hand while trying to support the frame with the other hand, or must seek assistance. Thus, erection of the tent by one person can be particularly frustrating and time-consuming.

SUMMARY OF THE INVENTION

It is among the objects of the present invention to provide an improved tent of the type having a skeleton frame which can be easily erected by one person. It is therefore among the objects of the present invention to provide such a tent in which the frame is self-supporting and can stand alone. It is further among the objects of the present invention to provide such a tent that is compact, lightweight, and has a minimum of parts, for easy storage and handling; to provie such a tent that is of simple, reliable, and easy to use construction; and to provide such a tent that is of inexpensive construction.

Generally, the tent of this invention comprises a fabric shell supported on a skeleton frame having at least two criss-crossing ribs. Depending upon the type of tent, these ribs may be rigid, resilient, or they may be a combination of rigid and resilient portions. The portions of the ribs that criss-cross have patches of mating halves of a hook-and-loop type fastening material so that the ribs can be releasably attached to each other at the point where they criss-cross. Generally, the method of erecting a tent of this invention comprises providing ribs having patches of mating halves of hook-and-loop type fastening material on the portions that criss-cross, erecting the ribs to form the skeleton frame, and releasably attaching the ribs at the points where they criss-cross by joining the mating patches of the hook-and-loop type fastening material to form a free standing skeleton frame. The fabric shell can then be suspended on the frame.

Thus, with the tent of the present invention, the ribs can be releasably attached to each other to form a self-supporting frame that can stand alone without the shell, thereby eliminating the need to manually support the frame and making it easier for one person to erect the tent. Because the tent frame is self-supporting, the person erecting the tent has both hands free and is free to move about the frame to suspend the fabric shell from the frame. The tent of the present invention does not require any additional parts or hardware, and can be collapsed to a relatively compact and lightweight form that is easy to store and handle. The patches of hook-and-loop type fastening material provide simple, reliable, and easy attachment of the ribs. These patches also provide a guide for the proper alignment and assembly of the skeleton frame. Finally, the tent is of very simple and inexpensive construction.

These and other advantages will be in part apparent and in part pointed out hereinafter.

BRIEF DESCRIPTION OF THE DRAWINGS

Corresponding reference numerals indicate corresponding parts throughout the several views of the drawings.

DETAILED DESCRIPTION OF THE PREFERRED EMBODIMENT

Figure 1:
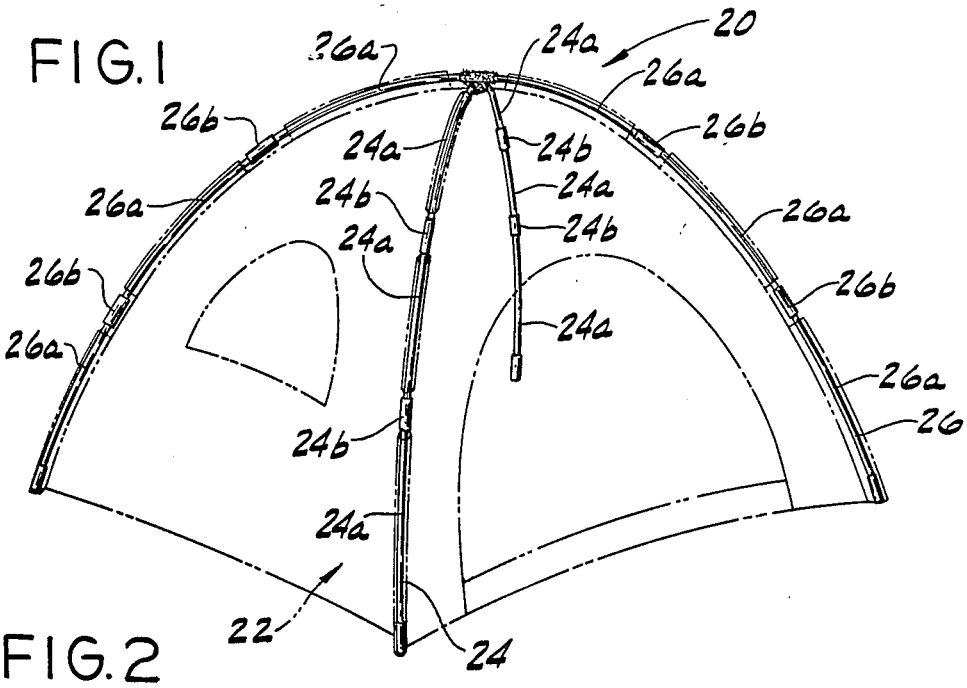
FIG. 1 is a perspective view of a tent frame having criss-crossing ribs constructed according to the principles of this invention, shown as it would support a fabric shell (shown in phantom) to form a tent.
Figure 2:
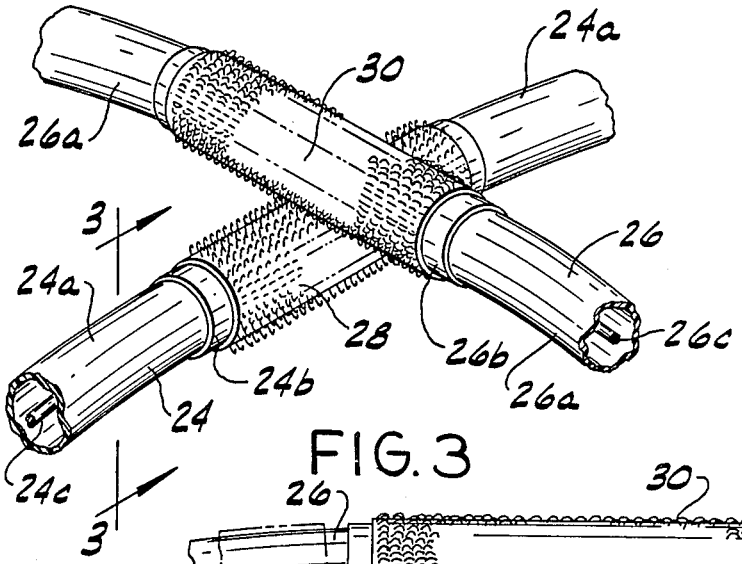
FIG. 2 is an enlarged perspective view of the criss-crossing ribs, showing their attachment.
Figure 3:
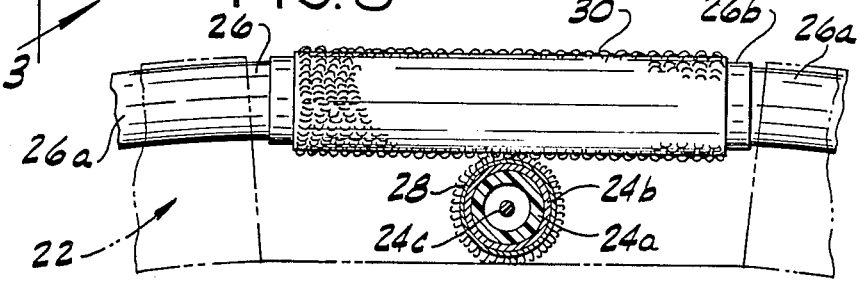
FIG. 3 is a cross-sectional view through one of the ribs taken along the plane of line 3—3 in FIG. 2, showing the attachment of the ribs.

A tent frame constructed according to the principles of this invention, indicated generally as 20, is shown in FIG. 1 as it would be erected to support a fabric shell 22 (shown in phantom) to form a tent. As used herein, the term fabric shell includes any flexible sheet material suitable for use in a tent. In this preferred embodiment the frame 20 comprises two flexibly resilient ribs 24 and 26 that criss-cross at the top of the frame 20. However, depending upon the type of tent, these ribs may be rigid, or be a combination of rigid and flexibly resilient portions. Although the preferred embodiment is described with respect to two ribs criss-crossing at the top of the frame, the invention is not so limited and can be incorporated into a tent having a frame in which the ribs criss-cross at some other location, or in which there are more than two ribs, or in which the ribs cross at more than one location.

As is known in the art, each of the flexibly resilient ribs 24 and 26 can comprise a plurality of sections **24*a* and 26*a*, respectively, connected by a plurality of socket members 24*b* and 26*b*, respectively. A resilient cord 24*c* and 26*c* may be provided through the sections forming each of the ribs 24 and 26**, to hold the sections together, while permitting the sections to be removed from their respective sockets and folded for compact storage and handling.

The portions of the ribs 24 and 26 that criss-cross are provided with patches 28 and 30, respectively, of mating halves of a hook-and-loop type fastening material, such as Velcro (trademark). As used herein, hook-and-loop type fastening material means any fabric fastener in which mating halves of the fastener releasably interengage. The patch 28 on rib 24 is the hook half of the material and the patch 30 on rib 26 is the loop half of the material. In the preferred embodiment the patches 28 and 30 extend around the circumference of respective ribs to provide for ready engagement between the ribs regardless of how the particular sections are oriented. The patches can be located around the socket members **24*b* and 26*b*, which have greater circumference than the sections 24*a* and 26*a*, to provide a greater area of attachment and therefore stronger attachment between the ribs. In addition to providing means for attaching the ribs, the patches 28 and 30 provide a ready guide or locating mechanism for the proper assembly of frame 20**, identifying the proper location where the ribs should criss-cross.

According to the method of this invention, the ribs 24 and 26, having the mating patches 28 and 30 on their apices where they criss-cross, are erected to form a skeleton frame for the tent. In the type of tent shown in the preferred embodiment, the ribs 24 and 26 are arranged in mutually perpendicular planes. The mating patches 28 and 30 are joined to releasably attach the ribs at the point where they criss-cross to form a free standing skeleton frame. The fabric shell forming the tent walls can then be suspended from the free-standing frame. Because the frame supports itself, both of the users hands are free, and the tent can be easily erected by one person working alone.

OPERATION

In the erection of the tent shown and described in the preferred embodiment, the floor of tent is laid out flat over the area where the tent is to be erected, with the rest of the shell 22 collapsed over the floor. The two ribs 24 and 26 are assembled. One end of one of the ribs, for example rib 24, is secured to a corner of the tent floor, such as by inserting the end into a sleeve formed in the corner of the floor for that purpose. The rib is then arched to form an inverted U-shaped bow member. The other end of the rib is then secured to the diagonally opposite corner of the tent floor. The bowed rib 24 is laid on the ground and the process is repeated at the remaining two corners of the tent floor with rib 26.

When both ribs 24 and 26 are secured to the tent floor, the bowed ribs are raised until they criss-cross in perpendicular vertical planes. The mating patches of hook-and-loop type fastening material are joined to releasably attach the ribs and form a free-standing frame 20. The shell can then be raised inside the frame 20 and secured at various points on the ribs 24 and 26 to form the tent.

The tent and tent frame of the present invention are compact and lightweight. They require no additional loose parts or hardware that could be lost, and the frame can still be collapsed to a relatively lightweight and compact form for easy storage and handling. The hook-and-loop type fastening material provides simple, reliable, and easy attachment of the ribs, and provides a guide facilitating the proper erection of the tent frame and tent.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. An improved tent of the type comprising a fabric shell supported on a skeleton frame having at least two criss-crossing ribs, the improvement comprising:

patches of mating halves of hook-and-loop type fastening material on portions of the ribs that criss-cross, one half of the hook-and-loop material being attached to one of said two criss-crossing ribs and the other half of the hook-and-loop material being attached to the other of said criss-crossing ribs, to releasably attach the ribs together at the point where they criss-cross and stabilize the frame.

2. The improved tent according to claim 1 wherein the mating patches of the hook-and-loop type fastening material extend substantially around the circumference of the ribs.

3. The improved tent according to claim 2 wherein the ribs comprise a plurality of tubular sections and a plurality of socket members joining the tubular sections, and wherein the patches of the hook-and-loop type fastening material extend around the circumference of the socket members.

4. The improved tent according to claim 1 wherein there are two flexibly resilient ribs adapted to be bent into two inverted U-shaped bows and erected in substantially perpendicular planes, and wherein the mating patches of hook-and-loop type fastening material are located at the apices of the bows.

5. Improved tent ribs for assembly in criss-crossing fashion to form a skeleton frame for supporting a fabric shell to form a tent, the improvement comprising:

mating patches of a hook-and-loop type fastening material on portions of the ribs that criss-cross, one half of the hook-and-loop material being attached to one of said two criss-crossing ribs and the other half of the hook-and-loop material being attached to the other of said criss-crossing ribs, to allow the ribs to be releasably attached at the point where they criss-cross to form a stable self-supporting frame.

6. The improved tent ribs according to claim 5 wherein the mating patches of the hook-and-loop type fastening material extend substantially around the circumference of ribs.

7. The improved tent ribs according to claim 6 wherein the ribs comprise a plurality of tubular sections and a plurality of socket members for joining the tubular sections, and wherein the mating patches of the hook-and-loop type fastening material extend around the circumference of the socket members.

8. A method of erecting a tent of the type comprising a fabric shell supported on a skeleton frame having at least two criss-crossing ribs, the method comprising the steps of:

providing ribs having patches of mating halves of hook-and-loop type fastening material on the sections of the ribs adapted to criss-cross, one half of the hook-and-loop material being attached to one of said two criss-crossing ribs and the other half of the hook-and-loop material being attached to the other of said criss-crossing ribs;

erecting the ribs to form the skeleton frame;

releasably attaching the ribs at the points where they criss-cross by joining the mating patches of the hook-and-loop type fastening material to form a free standing skeleton frame; and suspending the fabric shell on the free-standing skeleton frame to form the tent.

9. The method according to claim 8 wherein the mating patches of the hook-and-loop type fastening material extend substantially around the circumference of ribs.

10. The method according to claim 9 wherein each rib comprises a plurality of tubular sections and a plurality of socket members for joining the tubular sections, and wherein the mating patches of the hook-and-loop type fastening material extend around the circumference of at least one of the socket members.

11. The method according to claim 8 wherein there are two flexibly resilient ribs adapted to be bent inverted into U-shaped bows and erected in substantially perpendicular planes, and wherein the mating patches of hook-and-loop type fastening material are located at the apices of the bows.

* * * * *